United States Patent [19]

Dones

[11] Patent Number: 4,824,318

[45] Date of Patent: Apr. 25, 1989

[54] QUICK DISCONNECT CONTAINER CARRIER

[75] Inventor: Angel Dones, Miami, Fla.

[73] Assignees: Glenn Warner; Mark McCortney, both of Ocean Beach, Calif.

[21] Appl. No.: 873,861

[22] Filed: Jun. 11, 1986

Related U.S. Application Data

[63] Continuation-in-part of Ser. No. 596,819, Apr. 4, 1984, abandoned.

[51] Int. Cl.[4] ..... B66F 9/14

[52] U.S. Cl. ..... 414/607; 294/81.1

[58] Field of Search ..... 414/607, 608, 618, 619, 414/724, 785, 912, 786; 248/224.3, 224.4; 403/377; 294/68.3, 81.1, 81.5, 81.56

[56] References Cited

U.S. PATENT DOCUMENTS

| | | | |
|---|---|---|---|
| 2,547,222 | 4/1951 | Logan | 248/224.3 |
| 3,174,628 | 3/1965 | Kirch, Jr. | 248/224.3 X |
| 3,215,387 | 11/1965 | Thompson et al. | 248/224.3 |
| 3,387,729 | 6/1968 | Hindin et al. | 414/608 |
| 3,734,324 | 5/1973 | Lynch et al. | 414/608 |
| 3,752,346 | 8/1973 | Thompson et al. | 414/608 |
| 3,773,201 | 11/1973 | Thompson et al. | 414/608 |
| 3,797,460 | 3/1974 | Blankenship | 414/608 X |
| 4,024,973 | 5/1977 | Siderits et al. | 414/785 X |
| 4,395,188 | 7/1983 | Kaup | 414/785 X |
| 4,449,882 | 5/1984 | Perrott | 414/608 X |
| 4,544,323 | 10/1985 | Malin | 414/785 |

*Primary Examiner*—Robert J. Spar
*Assistant Examiner*—Gary Cundiff
*Attorney, Agent, or Firm*—Malin, Haley & McHale

[57] ABSTRACT

A static structure which attaches to a fork-lift for use in lifting empty cargo containers. The static structure has a horizontal cross member with a pair of hooks that can graspingly attach to pre-cast holes in the containers. The structure mounts on a fork-lift by means of plural vertical members rigidly affixed to the cross member, these horizontal members telescopingly fitting within recesses on a fork-lift's mast. This provides a simple, inexpensive, and reliable system for manipulating (especially stacking and unstacking) such empty cargo containers.

4 Claims, 2 Drawing Sheets

QUICK DISCONNECT CONTAINER CARRIER

This is a continuation-in-part of copending application Ser. No. 596,819 filed Apr. 4, 1984, now abandoned.

BACKGROUND OF THE INVENTION

This invention relates to apparatus for lifting, transporting and stacking cargo containers, and more particularly to a one piece cargo carrier which can be quickly and easily mounted upon and dismounted from a conventional fork lift truck and method for use.

It is the general practice to store empty cargo containers at shipping or repair yards in stacked relation prior to their being moved elsewhere for transporting cargo. Apparatus for lifting, transporting or stacking containers have heretofore been proposed, such as in U.S. Pat. No. 4,449,882 to Perrott, U.S. Pat. No. 3,174,628 to Kirch, Jr. and U.S. Pat. No. 3,387,729 to Hinden et al. However, none of the proposed apparatus have disclosed a lifting article that is quickly mountable and dismountable upon a conventional fork lift truck, which furthermore has no moving parts, is extremely inexpensive to make and efficient to use.

As is well known, the grounds in and around yards where cargo containers are stored are extremely dusty and the air tends to carry large amounts of dust particles which can interfere with the moving parts of a mechanical device, increasing maintenance costs and thereby decreasing the profitability of a business enterprise. The present invention, being of one piece design, eliminates the problems encountered by dust, dirt and other particulate matter moving in the air.

Cargo containers typically are of either the forty foot or twenty foot long variety. Twenty foot long containers are customarily constructed with reinforcing members or ribs across the transverse direction of their undersides spaced apart to accommodate the forks of a fork lift truck. However, forty foot long containers are usually not constructed with such ribs but are provided with, as are twenty foot long containers, openings in the outer and uppermost corners of the long sides to accommodate metal fingers which are connected to a lifting device. Such lifting devices have been provided with moving parts or with complicated structure that is expensive to manufacture.

SUMMARY OF THE INVENTION

The present invention is to a device and method for lifting, transporting or stacking cargo containers that has the unique and desirable features of being of one piece design and of simple construction, thereby having no moving parts and being extremely inexpensive to construct. The invention can be mounted in a rapid manner to any fork lift device by removing the forks and thereafter inserting the vertical support legs of the invention into holding brackets connected to the mast of the fork lift truck forming a rigid interconnection. Once the device is so mounted, hook means associated with the device are used to lift a cargo container using the fork lift's telescoping mast and to relocate said container by moving said fork lift.

In general, the invention consists of an elongated horizontal upper frame member to which are rigidly attached to opposite ends hook means for connection to a cargo container. Typically, such containers are constructed having integral corner pockets disposed in the upper corners of each side. The hook means of the present invention are brought into mating association with said pockets when lifting is desired. Rigidly connected to said horizontal member are a pair of parallel vertical support legs. Brace members are rigidly connected between the horizontal and vertical members for form truss-like structure. Further structural rigidity may be realized by adding web means between interconnected members. Because the device is used to lift long forty foot long containers, said hook means are disposed from each other a distance of approximately forty feet, or as far apart as are the pockets in said container.

For use with the instant invention, a fork lift must be provided with a pair of holding brackets connected to the movable portion of the mast of said fork lift, and the fork blades must be temporarily removed. Said pair of parallel vertical support legs of the instant invention are brought into mating association with said brackets in a manner to be specifically set forth hereinafter.

It is the principal object of the instant invention to provide a device for lifting, transporting and carrying cargo containers that is of one piece design, simple construction, and is quickly and easily detachable from a fork lift so that the fork lift can be used in its conventional manner.

It is another object of the present invention to provide a device for moving large cargo containers that is extremely inexpensive to construct and efficient to use.

It is a further object of the present invention to provide a device for lifting, transporting and stacking cargo containers that has no moving parts and therefore is maintenance free.

In accordance with these and other objects which will become apparent hereinafter, the instant invention will now be described with particular reference to the accompanying drawings.

DESCRIPTION OF THE PREFERRED EMBODIMENT

Figure 1:
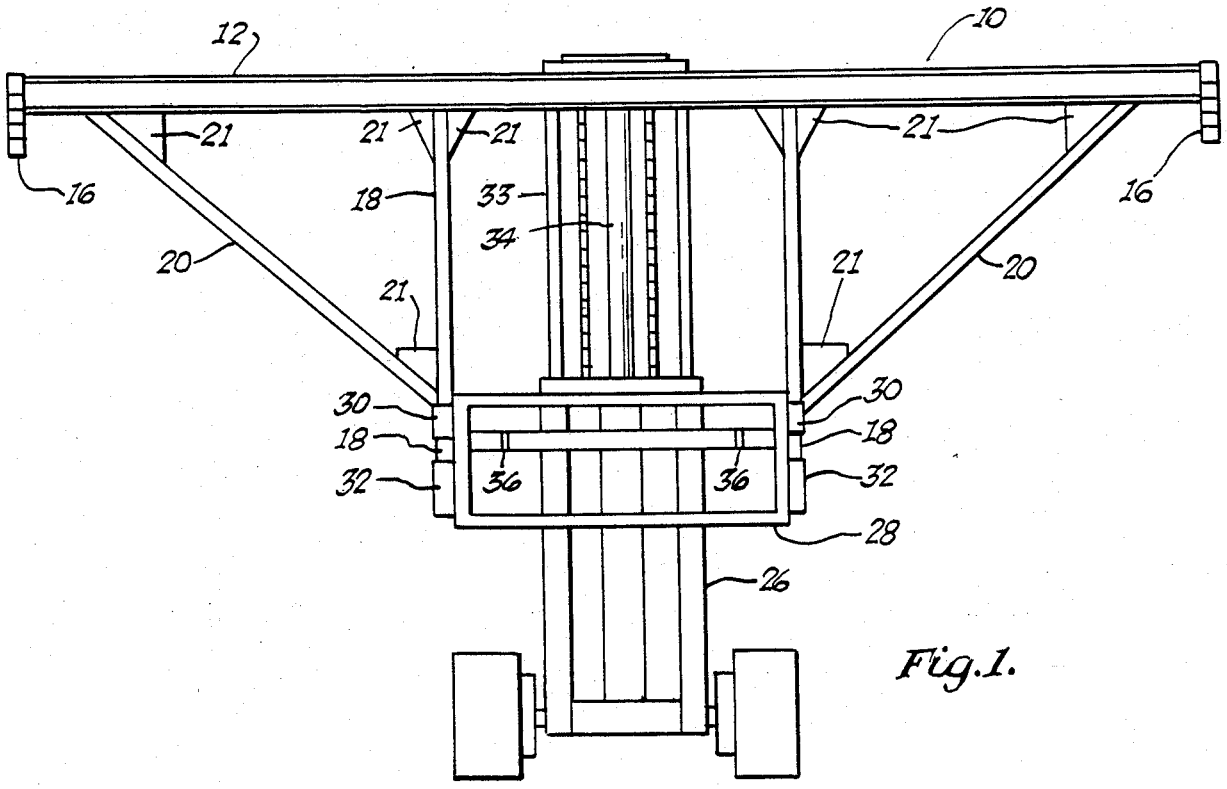
FIG. 1 is a front view of the fork lift attachment mounted upon a fork lift.
Figure 7:
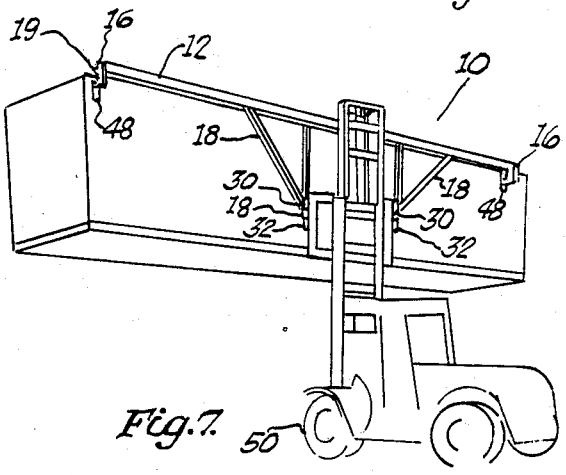
FIG. 7 shows the device lifting a forty foot long cargo container.

Referring now with particular reference to the drawing figures, FIGS. 1 and 7 show the device 10 of the instant invention which is comprised of an elongated horizontal frame member 12 having rigidly connected at each end a hook means 16 sized and shaped for attachment to a conventional forty foot long cargo container in a manner to be described subsequently. A pair of vertical parallel support legs or leg members 18 are rigidly connected to horizontal frame member 12 separated by a distance equal to approximately the outer width of a conventional fork lift truck carriage 28. In particular, the lower ends of legs 18 are slid into mating association with upper holding brackets 30 and lower holding brackets 32, collectively referred to as leg member bracket means for accepting said leg members in male-female mating association, rigidly disposed to the respective sides of carriage 28. When in place in this manner, the device is firmly held against the carriage 28 through the vertical leg 18/carriage 28 interconnection. Transverse brace members 20 connected between members 12 and 18 may be used to provide truss like stability to the invention. In addition, web means 21 for providing mechanical strength may be used.

Figure 2:
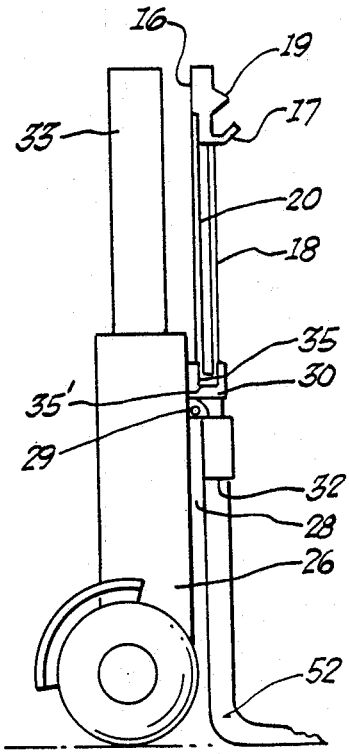
FIG. 2 is a left side view of FIG. 1.
Figure 4:
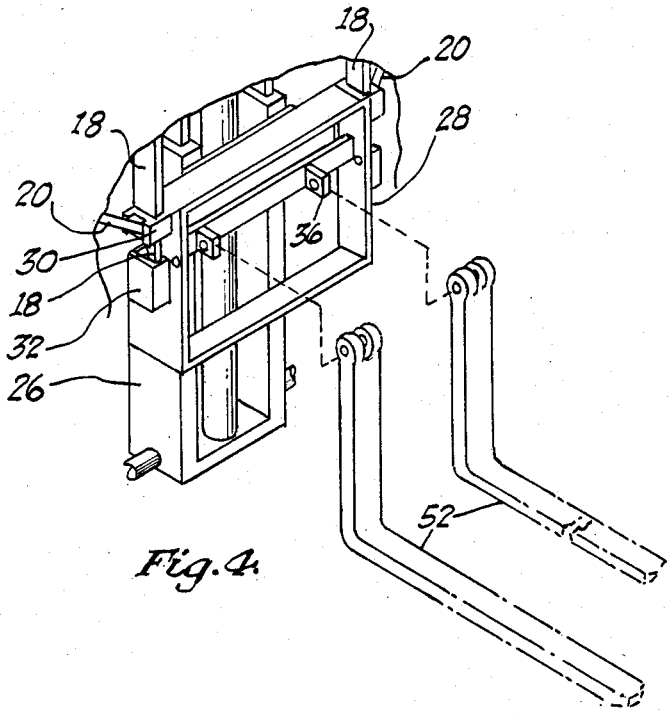
FIG. 4 is a perspective view of fork lift blades removed from a fork lift carriage.

In detail, each hook means 16 are comprised of a lower J-shaped finger-like protrusion 17 at its lower end and a pointed protrusion 19 near its medial portion, as shown in FIG. 2. Cargo containers ordinarily are equipped with corner pockets 48, as seen in FIGS. 4 and 7. In order to lift a cargo container 46 using the instant invention, finger-like protrusions 17 are inserted into pockets 40 while protrusions 19 act to guide protrusions 17 into registry with pockets 48, also seen in FIG. 8.

Figure 3:
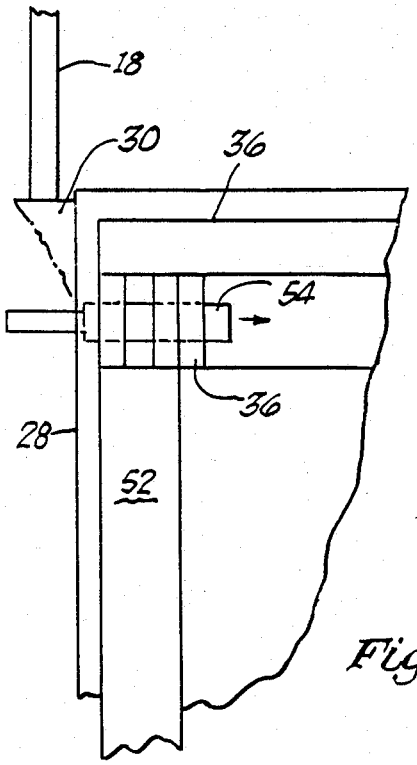
FIG. 3 is a partial perspective view of a fork lift blade holding pin being removed from a fork lift carriage.

Conventional fork lift 50 is provided with a pair of fork blades 52 connected using a pair of fork blade holding pins 54, shown in FIGS. 3 and 4, removably connected to fork lift carriage 28. Fork blades 52 are held in connection with carriage 28 by positioning pins 54 in registry with transverse fork blade holes 56 and simultaneously in registry with a hole in each pin bracket 36 connected to carriage 28.

Figure 5:
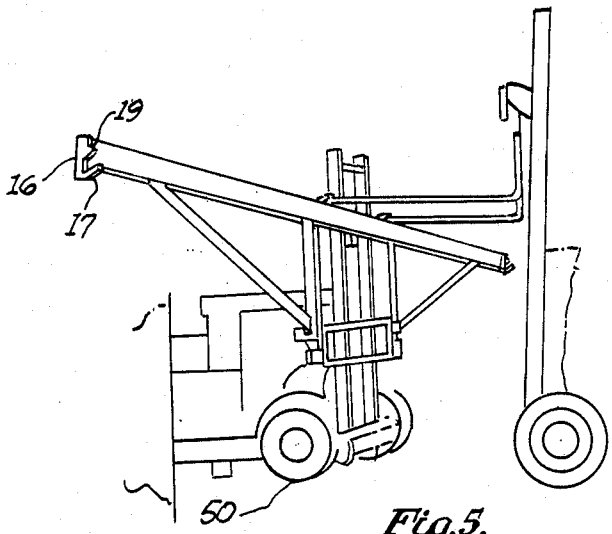
FIG. 5 shows the fork lift attachment being guided into place on one fork lift by a second fork lift.
Figure 6:
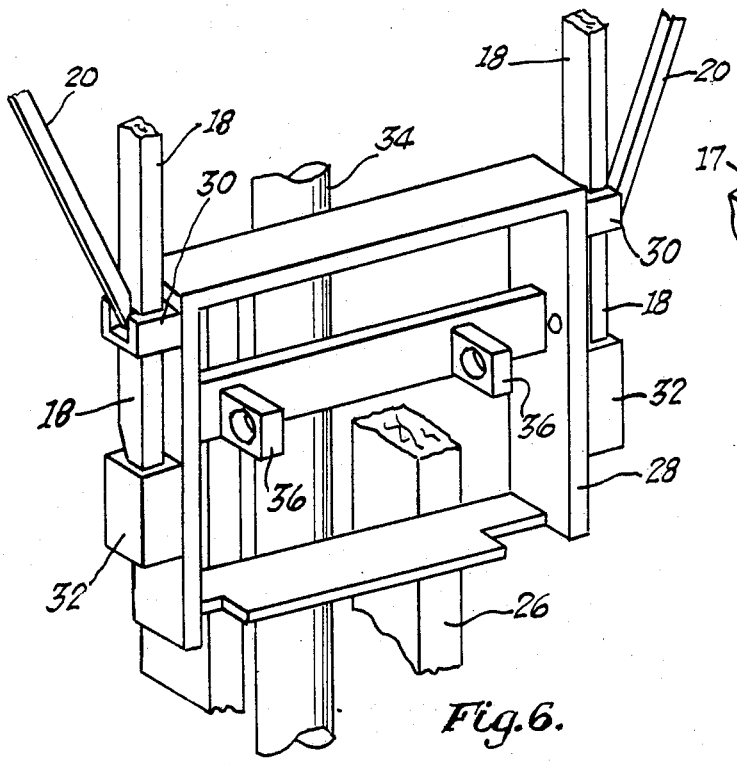
FIG. 6 shows a close up perspective view of the interconnection of the vertical support legs and holding brackets.

Lifting a cargo container 46 is accomplished by performing the steps of (1) removing fork lift blades from fork lift by removing holding pins 54 using an implement to punch said pin out of its registry with blades 52 and said holes in pin brackets 36 as shown in FIG. 3; (2) moving fork lift 50 away from removed blades 52 as shown in FIG. 4, and placing fork lift 50 in position to accept the cargo lifting device 10, as shown in FIG. 5; (3) sliding the lower portion of legs 18 into mating contact first with brackets 30 and further with brackets 32. In the preferred embodiment, as seen in FIGS. 2 and 6, brackets 32 are smaller in width than brackets 30 and legs 18 each have a notch 29 disposed therein. Also, brackets 30 have a slot 35 for accepting the lower end portion of brace members 20. In this way, once legs 18 are inserted into brackets 30 and 32 to the point where the end of notch 29 contacts the top of bracket 32 and simultaneously brace member 20 contacts the bottom 35' of notch 35, a sure tight fit of device 10 to carriage 28 is achieved ensuring safe operation of the invention. Continuing with the stages for employing the instant invention, the next step is to (4) place the device 10 as mounted upon carriage 28 of fork lift 50 into position for lifting a container 46, and (5) engaging finger-like protrusions 17 in mating relation into pockets 48 and raising telescoping fork lift mast 33 and 34 in the conventional manner, and (6) transporting said container 46 to the desired location.

Figure 8:
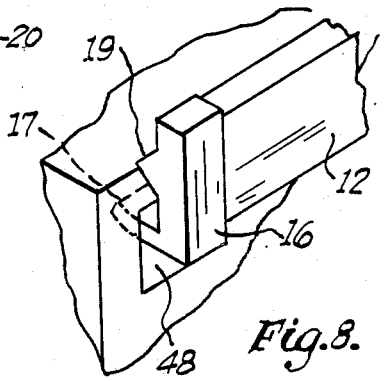
FIG. 8 is an exploded view of the upper left hand corner of the container of FIG. 7.

As best seen in FIG. 8, protrusions 17 are engaged within pockets 48. At the same time, the lower portion of container 46 comes into planar contact with carriage 28 providing support against rotation of said container 46.

The invention just described allows for the double use of a conventional fork lift truck by providing for the quick and simple release of the conventional fork blades and subsequent replacement therefore of the device 10 that comprises the present invention.

It should be noted that brackets 30 and 32 are preferably welded as a modification to carriage 28.

The present invention has been shown and described in what is deemed to be the most practical and preferred embodiment. It is to be recognized that departures may be made therefrom within the scope of the invention and that obvious modifications will occur to a person skilled in the art.

What is claimed is:

1. A quick disconnect container carrier comprised of:

an elongated horizontal frame member sized to span the longitudinal length of a conventional cargo container;

a pair of hook means rigidly disposed one at each end of said elongated frame member sized and shaped for mating releasable connection to said cargo container;

a pair of parallel vertical leg members rigidly connected to said horizontal frame member separated by a distance equal to approximately the outer width of a conventional fork lift carriage;

a pair of transverse brace members connected kitty-corner between said vertical legs and said horizontal frame member;

a pair of leg member bracket means for accepting said vertical leg members in male-female mating association, each of said bracket means being rigidly connected to a side portion of said fork lift carriage.

2. The quick disconnect container carrier of claim 1, wherein said pair of hook means are sized and shaped so as to provide support against vertical displacement of the cargo container due to gravity alone, said pair of hook means thereby allowing said lower longitudinal length of said cargo container to rotate toward said fork lift carriage, said lower portion of said cargo container thereby coming into abutting contact with said fork lift carriage so as to provide support against rotation of said cargo container.

3. The quick disconnect container carrier of claim 2, wherein each said hook means has a lower end, medial portion and an upper end, each said hook means being comprised of a lower J-shaped finger-like protrusion at its lower end and a pointed protrusion near its medial portion, said J-shaped finger-like protrusion being adaptable for insertion into conventional lift pockets of a conventional cargo container, said pointed protrusions adapted to engage the upper longitudinal edge portion of said cargo container while said finger-like protrusions are being inserted into said pockets.

4. The quick disconnect container carrier of claim 1, wherein said bracket means for accepting said vertical leg members are comprised of an upper holding bracket and a lower holding bracket attached to each side of said fork lift carriage, each said upper holding bracket having a generally U-shaped notch cut-out means for receiving the respective lower ends of said transverse brace members.

* * * * *